United States Patent [19]

Stricker

[11] Patent Number: 4,531,920

[45] Date of Patent: Jul. 30, 1985

[54] TRANSVERSE WATERJET PROPULSION WITH AUXILIARY INLETS AND IMPELLERS

[76] Inventor: John G. Stricker, 871 Highland Ave., Annapolis, Md. 21403

[21] Appl. No.: 516,216

[22] Filed: Jul. 22, 1983

[51] Int. Cl.[3] ..... B63H 11/08

[52] U.S. Cl. ..... 440/47; 440/38

[58] Field of Search ..... 440/38, 40, 41, 42, 440/47, 43; 60/221, 222; 114/278

[56] References Cited

U.S. PATENT DOCUMENTS

| | | | |
|---|---|---|---|
| 3,082,732 | 3/1963 | Stallman | 115/16 |
| 3,106,179 | 10/1963 | Trausel | 440/47 |
| 3,598,080 | 8/1971 | Shields | 440/38 |
| 3,805,731 | 4/1974 | Furst | 440/47 |
| 3,809,005 | 5/1974 | Rodler | 115/12 R |
| 3,968,762 | 7/1976 | Meyer | 440/38 |
| 3,985,094 | 10/1976 | Stricker et al. | 115/14 |
| 3,998,177 | 12/1976 | Rhodes | 440/40 |
| 4,086,867 | 5/1978 | Stricker et al. | 115/14 |
| 4,214,544 | 7/1980 | Dashew | 440/40 |

*Primary Examiner*—Trygve M. Blix
*Assistant Examiner*—C. Bartz
*Attorney, Agent, or Firm*—Luther A. Marsh; Robert F. Beers

[57] ABSTRACT

A waterjet propulsion system having a transversely mounted engine driving one or more pumps with multiple inlets located so that at low speed, subplaning operations a greater flow of water is available, but at higher, planing speeds some inlets vent and a reduced flow is delivered to the pumps. This is accomplished by locating some inlets between the subplaning waterline and the planing waterline of the vehicle.

6 Claims, 3 Drawing Figures

TRANSVERSE WATERJET PROPULSION WITH AUXILIARY INLETS AND IMPELLERS

BACKGROUND OF THE INVENTION

This invention relates to water jet propulsion systems for marine vehicles and in particular to the pump and inlet design of water jet propulsors for planing craft.

Conventional planing craft waterjet propulsion systems consist of longitudinally installed engines and inboard mounted pumps. Nozzles and pump housings usually extend through transom cutouts, and inlet contours are faired to the hull at bottom cutouts. Matching of proper engine and pump shaft speeds is accomplished by use of step-up or step-down gearboxes where required, and various impeller sizes (usually termed "trims") are provided to match engine and pump torque characteristics. Nozzle sizes are often varied in combination with impeller trim and craft speed requirements.

For planing hull waterjet systems propulsive efficiencies at low to moderate speeds are generally much lower than for high speeds. The reason for this is that peak efficiency occurs at a fixed value of jet velocity ratio, which is the ratio of flow velocity from the nozzle to the forward boat speed, while typical planing hulls require increasing jet velocity ratios at low speeds in order to overcome hull drag. To maintain high efficiencies at low speeds some means of providing additional water flow through the propulsion unit is needed. One means of accomplishing this is by fitting a variable area nozzle to the pump, but this in turn requires variable geometry pump blading and some means of varying inlet system area as well if significant flow rate increases are to be provided. For these reasons variable nozzle systems have not been placed in general use. Since waterjet systems are not efficient at low speeds, sustained operation at these speeds is wasteful of fuel and may, for many applications, discourage the use of waterjet propulsors. When operating in the acceleration mode from stop to high speeds this inefficient region may create difficulties in terms of ability to provide adequate propulsion thrust. Failure to provide sufficient thrust in the low speed region will prevent the attainment of higher speeds where operation of the propulsion system may be satisfactory. The tendency for waterjet pumps to cavitate at low speed, high power conditions aggravates operating difficulties for conventional systems. Because pressure of the inflowing water is low while traveling at low forward boat speeds, cavitation of highly loaded pump impellers can occur under these conditions when application of full engine power is attempted. This limits the acceleration capability of the boat, and an improperly designed system can prevent attainment of normal operating boat speeds. Low operating efficiencies cause the cavitation limit to occur at higher boat speeds, thus presenting even tighter operational restrictions.

Conventional waterjet systems use engines mounted longitudinally and propulsion units mounted longitudinally with the nozzle mounted outboard of the transom. This arrangement places engines far forward of the transom, intruding on otherwise usable internal space. The pump and inlet are mounted inboard, using space and requiring the forward engine location. Installation is inconvenient and time consuming since mating with the hull inlet cutout (sometimes requiring hand-formed contours at the hull transition) and a transom cutout for the pump, nozzle and steering/reversing system is required. Maintenance and repair are likewise made more difficult by the relatively complicated installation design.

Steering of conventional waterjet systems is unresponsive at low speeds because high speed response characteristics would be oversensitive with a low speed optimized steering system. In addition, thrust at low engine speeds is typically low for waterjet systems (when compared to propellers) due to their small characteristic water flow rates. This contributes to a lack of steering response in conventional waterjet systems at low speeds.

The inboard mounting of conventional pump units requires use of positive shaft seals or packing glands which are often troublesome maintenance items. Thrust bearings capable of carrying high loads are also needed, these often being subject to failure caused by improper design, maintenance, or by contamination.

SUMMARY OF THE INVENTION

Briefly, the instant invention overcomes the disadvantages of the prior art by providing a waterjet propulsion design configured to be transversely mounted on the outside of the boat transom, driven by a belt, gear, or chain drive from an inside-mounted transverse engine. This drive arrangement gives a very compact, space-saving design which features inexpensive and convenient means of matching pump and engine speed and power characteristics, and results in a propulsion system center of gravity located further toward the stern than a conventional system. Inlets are integral with the pump units and do not require any bottom hole cutouts in the hull or hand-faired contours to be matched with the pump inlet ducting. A representative embodiment uses three pumps, the outer two being fed by inlets which are mounted at a higher elevation than the center inlet (which is flush with the hull bottom surface). When a planing boat hull is operating below its planing speed, water is dragged behind the transom due to boundary layer separation and formation of a circulation region. The outer inlets will, in this case, feed the outboard pumps which then produce thrust by increasing the fluid energy and ejecting high velocity jets through nozzles which are integral with the pump housings. At this condition the inner (center) pump, supplied by the flush inlet, produces thrust in a similar manner. Engine torque is maximum at this condition since three pumps are doing work, and engine speed will not reach its normal maximum if power output is at the limiting value. Tendency for the center pump to cavitate at the low boat speed, high power condition is reduced since cavitation increases with shaft rotational speed. Propulsive efficiency is high since total flowrate is much higher with three rather than just one operating pump. Likewise, the low momentum flow region behind the transom, from which the outer pumps draw flow, produces increased propulsive efficiency when compared to conventional inlets which would operate in hull-bottom boundary layer flow.

At boat speeds exceeding certain characteristic values which depend on hull size, loading and other parameters, the circulation region behind the hull vanishes and flow separates at the bottom-transom corner. At this planing condition, the outer pumps run dry due to ventilation of the higher-mounted inlets. The center pump operates normally, since its inlet is drawing water from the flow beneath the hull. Engine speed will increase due to the reduced shaft torque, and overall propulsion efficiency is high since the reduced overall flowrate matches requirements at these higher boat speeds. Steering at high speeds is less sensitive since the center nozzle alone is providing thrust. This reduced sensitivity is desirable since conventional waterjets may be prone to high speed steering instability brought on by need for large low speed steering system deflections.

Since typical power output curves flatten for gasoline and diesel engines when operating near their maximum output as a function of RPM, the high torque condition at low boat speeds may represent little decrease in total delivered power in a properly matched system. Note that the shaft speed when operating in the three pump mode will be, for a properly designed system, typically about 70 to 90% of the maximum reached when operating on the center pump only. Full or nearly full power will be available, then, at either operating condition if proper engine-pump speed matching is provided by the drive system.

OBJECTS OF THE INVENTION

It is therefore an object of this invention to provide higher efficiency of operation at low boat speeds, particularly with planing and semi-planing hulls, than can be realized with conventional waterjet propulsion systems.

It is a further object of this invention to provide a waterjet propulsion system that can be easily and inexpensively installed and maintained.

It is yet another object of this invention to provide a waterjet propulsion system with responsive steering control characteristics at low speed operations.

It is another object of this invention to provide a waterjet propulsion system capable of providing variable water flow without requiring variable geometry nozzle systems.

Other objects, advantages and novel features of this invention will become apparent from the following detailed description of the invention when considered along with the accompanying drawings.

DETAILED DESCRIPTION OF THE PREFERRED EMBODIMENTS

Figure 1:
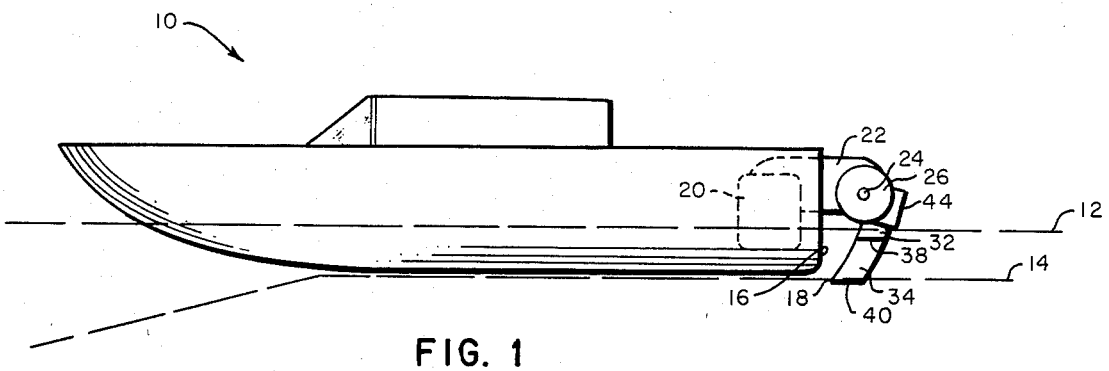
Figure 2:
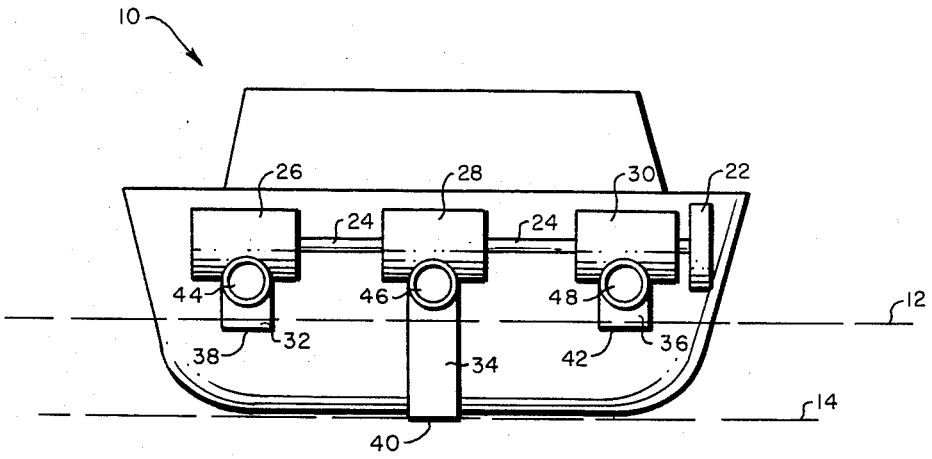
Figure 3:
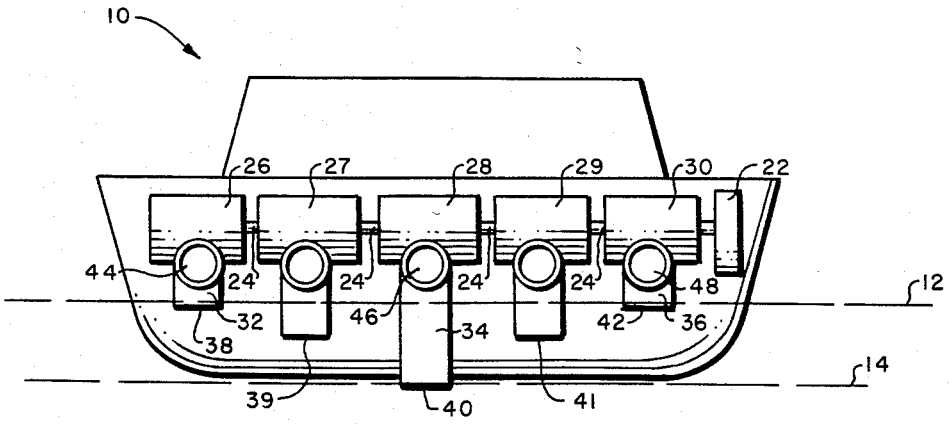

FIG. 1 shows generally a side view of a planing craft, 10, and FIG. 2 and FIG. 3 show a stern view of the craft. Two water lines are shown, 12 and 14. The higher waterline, 12, is associated with low speed, subplaning operation. In this situation, water is dragged behind the boat transom, 16, rather than separated at the bottom intersection, 18, as it is at planing speeds. At low speeds, this "dragged along" water has low momentum relative to the boat and the propulsive efficiency of water jet systems is known to improve with decreasing flow momentum. The lower waterline, 14, is characteristic of higher operating speeds when the boat is planing.

Referring to FIG. 1 and FIG. 2, an engine, 20 is mounted transversely within the boat and connected by a drive system, 22, to a shaft, 24, which operates three pumps, 26, 28 and 30. Each of the pumps is supplied with sea water by separate ducting, 32, 34 and 36 leading to inlets 38, 40 and 42, and each pump is connected to a separate out-flow nozzle, 44, 46 and 48.

The outboard inlets, 38 and 42, are located at a depth that places them in the low momentum region at low speeds, but above the high speed waterline, 14. Thus, at subplaning speeds, when the power requirements on the craft are highest, the outboard pumps, 26 and 30, are supplied with low momentum water and the center pump, 28, is supplied with higher momentum water from its lower inlet. Engine torque is at a maximum in this condition since all three pumps are operating under a loaded condition, and consequently the engine speed will be somewhat under its normal maximum if power output is the limiting value. This reduction in engine speed will have the beneficial effect of reducing the inefficient tendency of the center pump to cavitate since cavitation increases with increasing shaft rotational speed. Despite the reduced engine speed, the propulsive power will be maximized because of the greater total flow rate associated with all three pumps rather than just one, and the additional mass flow will produce an increased propulsive efficiency.

After planing speed is reached, the outboard inlets will be above the planing waterline, 14, and will ventilate, and the outboard pumps, 26 and 30, will run dry and unload, except for very small windage torques. The center pump, 28, will continue to operate normally because its inlet, 40, will still be below the planing speed waterline. Because of the reduction in shaft torque resulting from the unloading of the outboard pumps, engine speed will increase and the reduced total flow rate will match the high speed power requirements of the boat. Proper matching of the engine and pump speed by the drive system can result in full or nearly full power in either operating condition. Further control and balancing of the flow rates to each of the pumps can be obtained by including flow valves in the ducting between the inlets and the pumps. The shift from the low speed condition with all three pumps providing thrust to the planing speed condition with only the center pump providing thrust occurs automatically and without moving parts in response to the operating conditions. A more complex application of this staged inlet height concept could consist of retractably mounted ducting and inlets providing feed water for any or all of the waterjet pumps.

Because the outboard pumps, 26 and 30, only produce thrust during low speed, sub-planing conditions, their associated nozzles, 44 and 48, can be designed and directed at an angle to compensate for the characteristic tendency of planing craft to trim bow-up at low speeds. This will reduce hull drag and further increase propulsive efficiency. In addition, steering and reversing mechanisms can be attached to the outboard nozzles to provide more sensitive low speed control without affecting the planing speed control characteristics.

A number of alternatives and modifications to the present invention are suggested by the concept. Any number of pumps, ducting, and inlets can be used to advantage depending on the powering requirements of the vehicle, including split ducting with different inlet heights feeding the same pumps. The inlets can be located on the hull bottom with internal ducting and submerged inlet pods could also be employed. Intermediate inlet heights may be used to produce a smoother multi-step transition from low speed, high power requirements to the high speed, low power condition a five pump 26, 27, 28, 29, 30 configuration with two intermediate height inlets 39, 41 is shown in FIG. 3. The system described herein is not limited to planing craft but could be employed to provide auxiliary low speed power or thrust augmentation for any type of hull. Although the transversely mounted engine of the preferred embodiment has space saving advantages and requires only a single cut-out in the boat transom, the multiple height inlet concept could be applied to any sort of engine arrangement, including a fully outboard waterjet propulsion unit.

Obviously, many other modifications and variations of this invention are possible in light of the above teachings.

What is claimed is:

1. A waterjet propulsion system for a marine vehicle intended to propel said vehicle at variable speeds, where at high speeds said vehicle planes and has an associated high speed waterline and where at low speeds said vehicle does not plane and has an associated low speed waterline, said low speed waterline being higher relative to said vehicle than said high speed waterline, comprising:

at least one engine;

at least one pump drive shaft;

a transmission means connecting said engine to said pump drive shaft;

at least one primary pump and nozzle device driven by said pump drive shaft;

at least one lower inlet located below the high speed water line of the vehicle;

ducting connecting the lower inlet to the primary pump;

at least one auxiliary pump and nozzle device driven by said pump drive shaft;

at least one upper inlet located below the low water line of the vehicle but above the high speed water line; and ducting connecting the upper inlet only to the auxiliary pump.

2. In the waterjet propulsion system of claim 1 wherein the engine is mounted transversely with respect to the vehicle.

3. In the waterjet propulsion system of claim 1 wherein said upper inlet ducting further comprises ducting valves to control the flow of water to the auxiliary pump and nozzle devices.

4. In the waterjet propulsion system of claim 1 wherein the nozzles of the auxiliary pump and nozzle devices are directed at a downward angle to compensate for low speed trimming of the vehicle.

5. In the waterjet propulsion system of claim 1 wherein additional inlets are located at intermediate heights between the high speed waterline and the low speed waterline and each of said inlets is connected to at least one auxiliary pump and nozzle device.

6. A waterjet propulsion system for a marine vehicle intended to propel said vehicle at variable speeds, where at high speeds said vehicle planes and has an associated high speed waterline and where at low speeds said vehicle does not plane and has an associated low speed waterline, said low speed waterline being higher relative to said vehicle than said high speed waterline, comprising:

an engine;

a pump drive shaft transversely mounted at the stern of the vehicle;

transmission means connecting said engine to the pump drive shaft;

one center pump and nozzle device located along the vehicle centerline driven by said pump drive shaft;

two outboard pump and nozzle devices driven by said pump drive shaft;

a lower inlet located below the high speed waterline of the vehicle;

ducting said lower inlet to the center pump and nozzle device;

two upper inlets located between the high speed waterline and the low speed water line of the vehicle;

separate ducting connecting each of the two upper inlets only to an outboard pump and nozzle device.

* * * * *